US012486621B2

(12) United States Patent
Rau

(10) Patent No.: US 12,486,621 B2
(45) **Date of Patent: *Dec. 2, 2025**

(54) DUAL BALLAST CRIBBER

(71) Applicant: Soterran Group, LLC, Dakota Dunes, SD (US)

(72) Inventor: Michael A. Rau, Omaha, NE (US)

(73) Assignee: Soterran Group, LLC, Dakota Dunes, SD (US)

( * ) Notice: Subject to any disclaimer, the term of this patent is extended or adjusted under 35 U.S.C. 154(b) by 479 days.

This patent is subject to a terminal disclaimer.

(21) Appl. No.: 17/956,367

(22) Filed: Sep. 29, 2022

(65) Prior Publication Data

US 2023/0287631 A1 Sep. 14, 2023

Related U.S. Application Data

(63) Continuation of application No. 16/413,139, filed on May 15, 2019, now Pat. No. 11,459,707.

(60) Provisional application No. 62/671,881, filed on May 15, 2018.

(51) Int. Cl.
*E21B 27/04* (2006.01)
*E01B 27/04* (2006.01)

(52) U.S. Cl.
CPC ..... *E01B 27/04* (2013.01)

(58) Field of Classification Search
CPC ..... E01B 27/00; E01B 27/04; E02F 3/413; B66C 3/04
See application file for complete search history.

(56) References Cited

U.S. PATENT DOCUMENTS 2,486,479 A * 11/1949 Kennedy ..... B66C 3/20 414/626
3,553,859 A * 1/1971 mcIlrath ..... E01B 27/04 414/688
5,926,981 A * 7/1999 Theurer ..... E01B 27/04 104/2
8,607,480 B2 * 12/2013 Vuistiner ..... B66C 3/20 414/625

FOREIGN PATENT DOCUMENTS

DE 202018000428 U1 * 3/2018 ..... B66C 3/04
EP 2194193 A1 * 6/2010 ..... B66C 3/02
EP 2562308 A2 * 2/2013 ..... E01B 27/00
GB 2522454 A * 7/2015 ..... B66C 3/02

* cited by examiner

*Primary Examiner* — Christopher J Sebesta
(74) *Attorney, Agent, or Firm* — Ballard Spahr LLP

(57) ABSTRACT

A dual ballast cribber for on-rail operation for preventing and removing cemented ballast with minimal site preparation can include a central frame, a plurality of wheels, a first pivot arm, a second pivot arm, a first cribber bucket, a second cribber bucket, a first clamp, a second clamp, and a hydraulic system. The dual ballast cribber may perform a digging cycle in 2 minutes or less. Preferably the digging cycle is performed in 45 seconds or less.

18 Claims, 8 Drawing Sheets

DUAL BALLAST CRIBBER

CROSS-REFERENCE TO RELATED APPLICATION

The present application is a continuation application of U.S. application Ser. No. 16/413,139, filed May 15, 2019, which claims priority to and the benefit of the filing date of U.S. Provisional Patent Application No. 62/671,881, filed May 15, 2018, the disclosure of which is hereby incorporated by reference herein in its entirety for all purposes.

BACKGROUND

Many conventional railroads include crushed stone ballast underneath the rails and ties of the railway. The ballast functions to support the railway, provide vibration dampening, and facilitate drainage of water away from the railway. These functions extend the longevity of the railway. A common problem associated with ballast is that it often becomes clogged due to improper draining. The motion of a train over the railway having clogged or fouled ballast can cause water and mud to be brought from underneath the railway to the surface. This water and mud can then harden around the ballast in the consistency of concrete. This effect is sometimes referred to as cemented ballast. Cemented ballast can lead to problems with the railway, such as railway buckling or flooding.

Conventional methods to prevent ballast from cementing or to break apart cemented ballast include sledding, cribbing buckets, and undercutting. These conventional methods present practical limitations and inefficiencies in preventing ballast from cementing or breaking apart and removing cemented ballast. For example, the conventional method of sledding to prevent ballast from cementing includes inserting a specialized sled under the track and running it parallel to the rail to push fouled ballast to the outside of the rail. However, sledding requires site preparation, which includes lifting the rail and excavating underneath the rail to insert and pull the sled. Moreover, sledding is inefficient (e.g. it requires additional time), as it requires off-rail equipment to pull the sled. Finally, sledding is not seen as a solution for breaking apart cemented ballast.

Further, conventional methods that do allow for breaking apart of cemented ballast have practical limitations and inefficiencies. The conventional method of undercutting includes using a specialized undercutter to cut cemented ballast from underneath the railway, in a manner similar to a chainsaw and in parallel to the railway. Undercutting also requires site preparation of lifting the rail and excavating underneath the rail to insert the undercutting machine to allow it to cut horizontally and in parallel with the railway. It is also an off-rail method leading to increased inefficiency for placement and movement of the undercutter.

Finally, a conventional cribbing bucket may be used to prevent or break apart cemented ballast. The conventional cribbing bucket is attached to off-rail equipment, such as a backhoe or excavator, where the cribbing bucket digs underneath the ties to remove fouled ballast. Using a conventional cribbing bucket is inefficient as is requires off-rail equipment and a significant amount of time to move and position the equipment between each rail tie. Additionally, the cribbing bucket only removes fouled ballast from a single side at a time. Further, it has the practical limitation of requiring an experienced operator to run the cribbing bucket without damaging the ties or rail of the railway.

It is desirable to have an apparatus for preventing and removing cemented ballast that is an on-rail (e.g. travels on the railway) solution that requires minimal to no site preparation. It is further desirable for the apparatus to remove fouled ballast from both sides of the railway simultaneously or nearly simultaneously. Finally, it is desirable for the apparatus to operate with minimal operator experience and in less time intensive manner (e.g. increased efficiency).

SUMMARY

In accordance with embodiments disclosed herein, a dual ballast cribber for removing fouled and cemented ballast from beneath a railway can comprise a central frame and a plurality of wheels rotatably attached to the central frame. The railway can have a longitudinal axis. A first pivot arm can be pivotably attached to the central frame. A first cribber bucket can be pivotably attached to the first pivot arm. The first pivot arm can be configured to position the first cribber bucket about and between a digging position and a cleanout position. A second pivot arm can be pivotably attached to the central frame. A second cribber bucket can be pivotably attached to the second pivot arm. The second pivot arm can be configured to position the second cribber bucket about and between a digging position and a cleanout position. A first clamp can be in mechanical communication with the central frame and configured to secure the dual ballast cribber to the railway. At least one actuator can be configured to move each of the first and second cribber buckets between the respective digging position and the respective cleanout position. When in the digging position, each respective cribber bucket can be disposed below a respective clamp of the first and second clamps, and when in the respective cleanout position, the respective cribber bucket can be positioned outwardly from the respective clamp of the first and second clamps relative to a transverse axis that is perpendicular to the railway axis.

The at least one actuator can comprise two hydraulic actuators, wherein each actuator of the two hydraulic actuators can be configured to move a respective pivot arm of the first and second pivot arms.

The central frame of the dual ballast cribber can have a first side and a second side, wherein the first side and the second side are spaced from each other on the transverse axis. The first pivot arm can extend from the first side of the central frame, and the second pivot arm can extend from the second side of the central frame.

The dual ballast cribber can further comprise a second clamp that is in mechanical communication with the central frame and configured to secure the dual ballast cribber to the railway, wherein the first clamp is on the first side of the central frame, and the second clamp is on the second side of the central frame.

The first cribber bucket can be from 0.10 to 0.35 meters in width.

The first cribber bucket can be from 0.7 to 1.7 meters in length.

The first cribber bucket can be adjustably coupled to the first pivot arm so a distal end of the first cribber bucket can be positioned at a select distance from a pivotal axis of the first cribber bucket.

The first clamp can be adjustably coupled to the central frame so that a distal end of the first clamp can be positioned at a select distance from a pivotal end of the first clamp.

The dual ballast cribber can further comprise a sweep plate that is pivotably attached to the central frame about a pivotal axis and a sweep plate actuator that is configured to pivot the sweep plate about the pivotal axis of the sweep plate.

The dual ballast cribber can further comprise at least one vibrator motor that is configured to cause at least one of the first cribber bucket and the second cribber bucket to vibrate.

The dual ballast cribber can further comprise a vibrator sequence valve that is configured to deliver hydraulic fluid to the at least one vibrator motor when a hydraulic pressure surpasses a predetermined threshold.

The at least one vibrator motor can be attached to at least one of the first pivot arm and the second pivot arm.

The dual ballast cribber can further comprise a first clamp cylinder configured to engage and disengage the first clamp, a second clamp cylinder configured to engage and disengage the second clamp, and a dig circuit configured rotationally move the first pivot arm and the second pivot arm.

The dual ballast cribber can comprise a first dig cylinder that is in mechanical communication with the central frame and the first pivot arm and is in fluid communication with the dig circuit, and a second dig cylinder that is in mechanical communication with the central frame and the second pivot arm and is in fluid communication with the dig circuit.

The dual ballast cribber can further comprise a cleanout circuit that is configured to rotationally move the first cribber bucket and the second cribber bucket. The cleanout circuit can comprise a first cleanout cylinder that is in mechanical communication with the first pivot arm and the first cribber bucket and is in fluid communication with the cleanout circuit, and a second cleanout cylinder that is in mechanical communication with the second pivot arm and the second cribber bucket and is in fluid communication with the cleanout circuit.

The first clamp cylinder and the second clamp cylinder can be in fluid communication with the dig circuit.

The first clamp cylinder and the second clamp cylinder can be in fluid communication with the cleanout circuit.

A method of performing a digging cycle to remove fouled and cemented ballast from a railway with a dual ballast cribber can comprise: with a dual ballast cribber aligned on a railway, the dual ballast cribber having a central frame, first and second clamps in mechanical communication with the central frame, first and second pivot arms that are pivotably attached to the central frame, and first and second cribber buckets that are pivotably attached, respectively, to the first and second pivot arms, using the first clamp and the second clamp to clamp the dual ballast cribber to the railway for digging; using a dig circuit to move the first pivot arm and the second pivot arm rotationally downward, wherein the first cribber bucket and the second cribber bucket approximately simultaneously contact ballast underneath the railway; using the dig circuit to move the first pivot arm and the second pivot arm rotationally upward; using a cleanout circuit to move the first cribber bucket and the second cribber bucket to an open position to expel the ballast from the first cribber bucket and the second cribber bucket; and disengaging the first clamp and the second clamp from the railway to complete the digging cycle.

The digging cycle can be completed in two minutes or less.

The digging cycle can be completed in forty-five seconds or less.

DETAILED DESCRIPTION

Figure 1A:
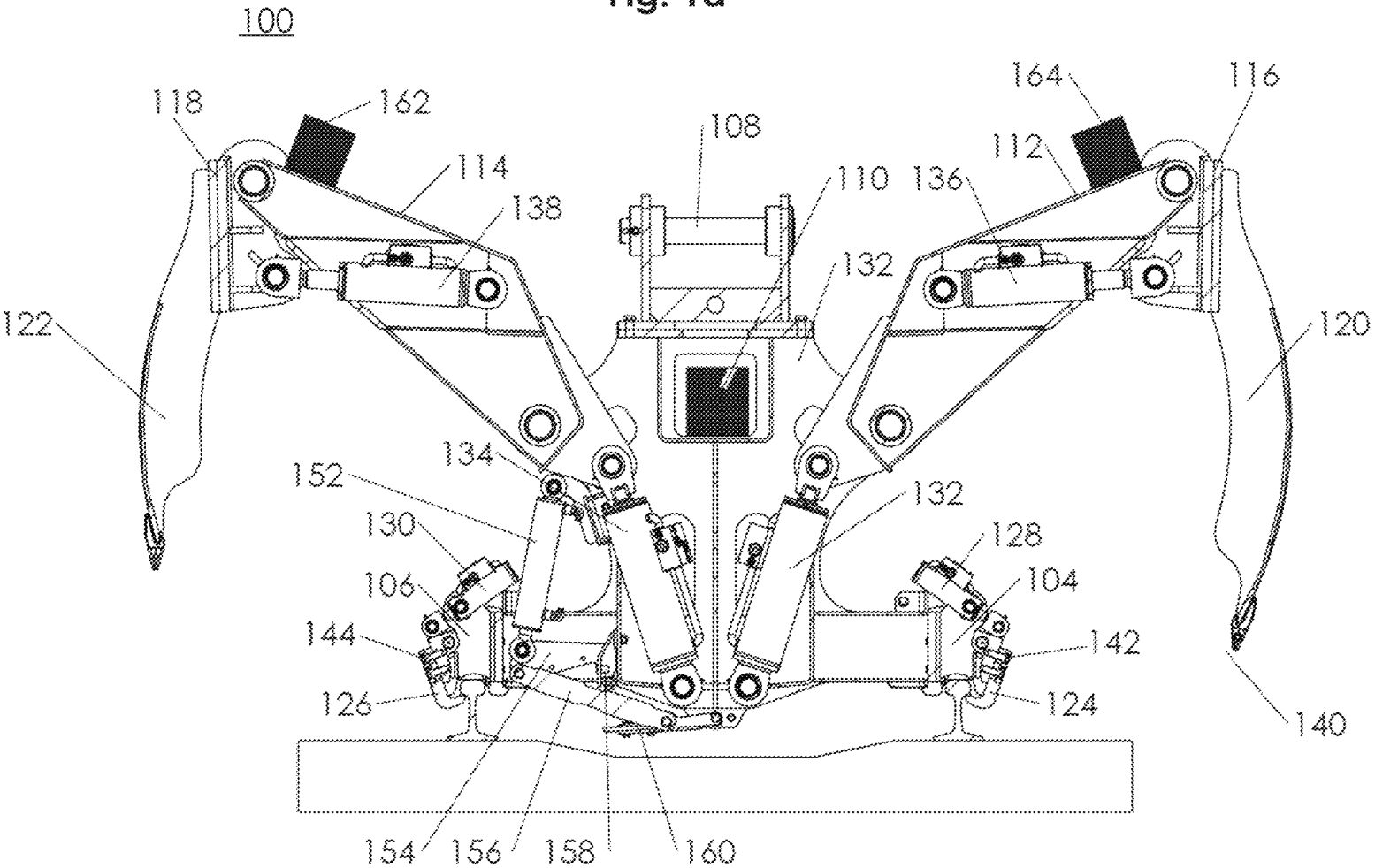
FIG. 1*a* illustrates a front view of a dual ballast cribber in a cleanout position with cribber buckets in a closed position, in accordance with embodiments disclosed herein.

The present invention now will be described more fully hereinafter with reference to the accompanying drawings, in which some, but not all, embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" include plural referents unless the context clearly dictates otherwise. For example, use of the term "a cylinder" can refer to one or more of such cylinders, and so forth.

All technical and scientific terms used herein have the same meaning as commonly understood to one of ordinary skill in the art to which this invention belongs unless clearly indicated otherwise.

As used herein, the terms "optional" or "optionally" mean that the subsequently described event or circumstance may or may not occur, and that the description includes instances where said event or circumstance occurs and instances where it does not.

As used herein, the term "at least one of" is intended to be synonymous with "one or more of." For example, "at least one of A, B and C" explicitly includes only A, only B, only C, and combinations of each.

Ranges can be expressed herein as from "approximately" one particular value, and/or to "approximately" another particular value. When such a range is expressed, another aspect includes from the one particular value and/or to the other particular value. Similarly, when values are expressed as approximations, by use of the antecedent "approximately," it will be understood that the particular value forms another aspect. It will be further understood that the endpoints of each of the ranges are significant both in relation to the other endpoint, and independently of the other endpoint. Optionally, in some aspects, when values are approximated by use of the antecedent "approximately," it is contemplated that values within up to 15%, up to 10%, up to 5%, or up to 1% (above or below) of the particularly stated value can be included within the scope of those aspects.

The word "or" as used herein means any one member of a particular list and also includes any combination of members of that list.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

Disclosed herein, according to various aspects and with reference to the Figures is a dual ballast cribber for on-rail operation for preventing and removing cemented ballast with minimal site preparation. The dual ballast cribber can include a central frame, a plurality of wheels, a first pivot arm, a second pivot arm, a first cribber bucket, a second cribber bucket, a first clamp, a second clamp, and a hydraulic system. While it is to be understood that this apparatus could be shown for use on a number of different on-rail machines, it is disclosed and described as being associated with a hydraulic excavator equipped with rail travel gear.

FIG. 1*a* illustrates a front view of a dual ballast cribber 100 in a cleanout position having cribber buckets in a closed position. The dual ballast cribber 100 can include a central frame 102, a first wheel 104, a second wheel 106, a third wheel 105 (FIG. 1*b*), a fourth wheel 107 (FIG. 1*b*), a first pivot arm 112, a second pivot arm 114, a first cribber bucket 120, a second cribber bucket 122, a first clamp 124, a second clamp 126, and a hydraulic system 200. Each of the first and second cribber buckets 120, 122 can define a receiving space 123 and a front opening 125 in communication with the receiving space for receiving the fouled and cemented ballast. The central frame 102 may include an attachment 108 configured to attach the dual ballast cribber 100 to an on-rail machine. The central frame 102 may further include a laser 110 configured to align the dual ballast cribber to perform a method of digging. The central frame 102 may further be configured to protect at least part of the hydraulic system 200 from debris and ballast during a dig cycle. The central frame 102 can comprise a non-reactive material, such as steel, metal composite, and the like.

The first wheel 104, the second wheel 106, the third wheel 105, and the fourth wheel 107 can be configured to allow the dual ballast cribber 100 to move along the railway as an on-rail apparatus. The first wheel 104, the second wheel 106, the third wheel 105, and the fourth wheel 107 are in mechanical communication with the central frame 102, and may be formed as a part of the central frame 102. The first wheel 104, the second wheel 106, the third wheel 105, and the fourth wheel 107 may be of any non-reactive material, such as steel, metal composites, or the like. The first wheel 104, the second wheel 106, the third wheel 105, and the fourth wheel 107 may be caster wheels.

The first pivot arm 112 and the second pivot arm 114 are configured to position the first cribber bucket 120 and the second cribber bucket 122 in a digging position, in which each cribber bucket is disposed below a respective rail, and a cleanout position, in which each bucket is spaced outwardly from the rails, with respect to a transverse axis 92 that is perpendicular to the railway's longitudinal axis 90. The first pivot arm 112 and the second pivot arm 114 are in mechanical communication with the central frame 102. The first pivot arm 112 and the second pivot arm 114 may be configured to protect at least part of the hydraulic system 200 from debris and ballast during a dig cycle, for example, by housing various hydraulic lines. The first pivot arm 112 and the second pivot arm 114 can be from 1 to 2 meters in length. Preferably, the first pivot arm 112 and the second pivot arm 114 are from 1.2 to 1.8 meters in length. Most preferably, the first pivot arm 112 and the second pivot arm 114 are from 1.5 to 1.7 meters in length. The first pivot arm 112 and the second pivot arm 114 may be made of any non-reactive material such as steel, metal composites, or the like. In the cleanout position, the first pivot arm 112 and the second pivot arm 114 can be angled upward, such as from 30 to 60 degrees with respect to a vertical axis. Although the first and second pivot arms 112, 114 are illustrated herein as single, rigid members, it should be understood that in further embodiments consistent with the present disclosure, the first and second pivot arms 112, 114 can comprise a plurality of connected members. Said connected members can be pivotably connected to each other and independently actuated to enable further articulation of the pivot arms and, therefore, the cribber buckets.

The first cribber bucket 120 and the second cribber bucket 122 are configured to remove fouled ballast from the railway to prevent it from becoming cemented ballast, and may further be configured to remove cemented ballast from the railway. The first cribber bucket 120 and the second cribber bucket 122 may be of a width (i.e., along the railway's longitudinal axis 90) configured to fit between the ties of the railway for on-rail operation, such as from 0.10 to 0.35 meters in width. Preferably, the first cribber bucket 120 and the second cribber bucket 122 are from 0.10 to 0.30 meters in width. Most preferably, the first cribber bucket 120 and the second cribber bucket 122 are from 0.15 to 0.25 meters in width.

The first cribber bucket 120 and the second cribber bucket 122 can be from 0.7 to 1.7 meters in length (i.e., in the longitudinal dimension of the cribber bucket, from the cribber bucket's distal end to its opposing end). According to some aspects, the first cribber bucket 120 and the second cribber bucket 122 are from 0.9 to 1.5 meters in length. In some embodiments, the first cribber bucket 120 and the second cribber bucket 122 are from 1.1 to 1.3 meters in length. The first cribber bucket 120 and the second cribber bucket 122 may remove 0.05 cubic meters or less of fouled or cemented ballast in a single digging cycle. The cribber buckets 120, 122 can each have base portions 127 that extend the width of the cribber buckets along the longitudinal axis 90. The base portions 127 can be curved about a radius that is perpendicular to the longitudinal axis 90. The base portions 127 can have a radius of approximately the length of the cribber bucket's respective pivot arm. The cribber buckets 120, 122 can further have side walls 129 that extend perpendicularly to the respective base portion 127 on each side so that the cribber buckets 120, 122 can define an internal volume (the receiving space 123). The base portion 127 of each cribber bucket can have a front edge 131, and the side walls 129 can have respective front edges 133. The front edge 131 of the base portion 127 and front edges 133 of the side walls 129 can define the front opening 125 of the respective cribber bucket. Although one embodiment is illustrated herein, cribber buckets 120, 122 can employ various other profiles and configurations for extending between rail ties and scooping ballast below the railway.

The first cribber bucket 120 and the second cribber bucket 122 may include at least one penetrating tooth 140, where the penetrating tooth 140 is configured to break apart fouled or cemented ballast for removal. The penetrating tooth 140 may be formed as a part of the cribber bucket. The penetrating tooth may include a single point. The penetrating tooth 140 may include several points formed as part of the cribber bucket, such as serrated edge. In the cleanout position the first cribber bucket 120 and the second cribber bucket 122 can be raised above the railway and spaced outwardly from the rails relative to the transverse axis 92. In the closed position, the first cribber bucket 120 and the second cribber bucket 122 are pivoted so that the cribber buckets' respective distal ends are more proximal to the central frame 102 than when the cribber buckets are in their respective open positions.

The first cribber bucket 120 is in mechanical communication with the first pivot arm 112, and the second cribber bucket 122 is in mechanical communication with the second pivot arm 114. The first cribber bucket 120 may be in mechanical communication with the first pivot arm 112 via a first adjustable attachment 116, and the second cribber bucket 122 may be in mechanical communication with the second pivot arm 114 via a second adjustable attachment 118. The first adjustable attachment 116 and the second adjustable attachment 118 can be configured to position the first cribber bucket 120 and the second cribber bucket 122 at different ballast depths of the railway in the digging position to target specific areas of fouled or cemented ballast. For example, the first adjustable attachment 116 and the second adjustable attachment 118 may be mounting plates that are pivotable with respect to their respective pivot arms. Each mounting plate can comprise a plurality of bolt holes (e.g., four sets of two bolt holes). The bolt holes can receive mounting hardware to attach a respective cribber bucket in a plurality of positions relative to the respective cribber bucket's longitudinal dimension. The first cribber bucket 120 and the second cribber bucket 122 may be manually attached to the first pivot arm 112 via the first adjustable attachment 116 and the second pivot arm 114 via the second adjustable attachment 118, respectively. Accordingly, the distal ends of the cribber buckets can be positioned at a select distance from their respective pivotal axes.

The first clamp 124 and the second clamp 126 are configured to secure the dual ballast cribber 100 to respective rails of the railway during digging and cleanout. The first clamp 124 and the second clamp 126 are in mechanical communication with the central frame 102. The first clamp 124 and the second clamp 126 may be in mechanical communication with the central frame 102 via a third adjustable attachment 142, and a fourth adjustable attachment 144, respectively. The third adjustable attachment 142 and the fourth adjustable attachment 144 can be configured for mechanical communication of the first clamp 124 and the second clamp 126 to the central frame 102 to accommodate different rail heights for clamping of the first clamp 124 and the second clamp 126 to the rail. For example, the third adjustable attachment 142 and the fourth adjustable attachment 144 may be a plurality of bolt holes (e.g., four sets of from two to four bolt holes), where each set of bolt holes is configured for attachment of the first clamp 124 or the second clamp 126. The plurality of bolt holes can provide for multiple attachment locations for the first and second clamps 124, 126 along the first and second clamps' respective longitudinal dimension. Accordingly, the respective distal ends of the first and second clamps 124, 126 can be positioned at a select distance from their respective pivotal axes. Although the dual ballast cribber 100 is illustrated herein as having first and second clamps 124, 126, it should be understood that in further embodiments, a single clamp may be used to hold the dual ballast cribber 100 in place on the railway, while in still further embodiments, three or more clamps may be used.

Figure 1B:
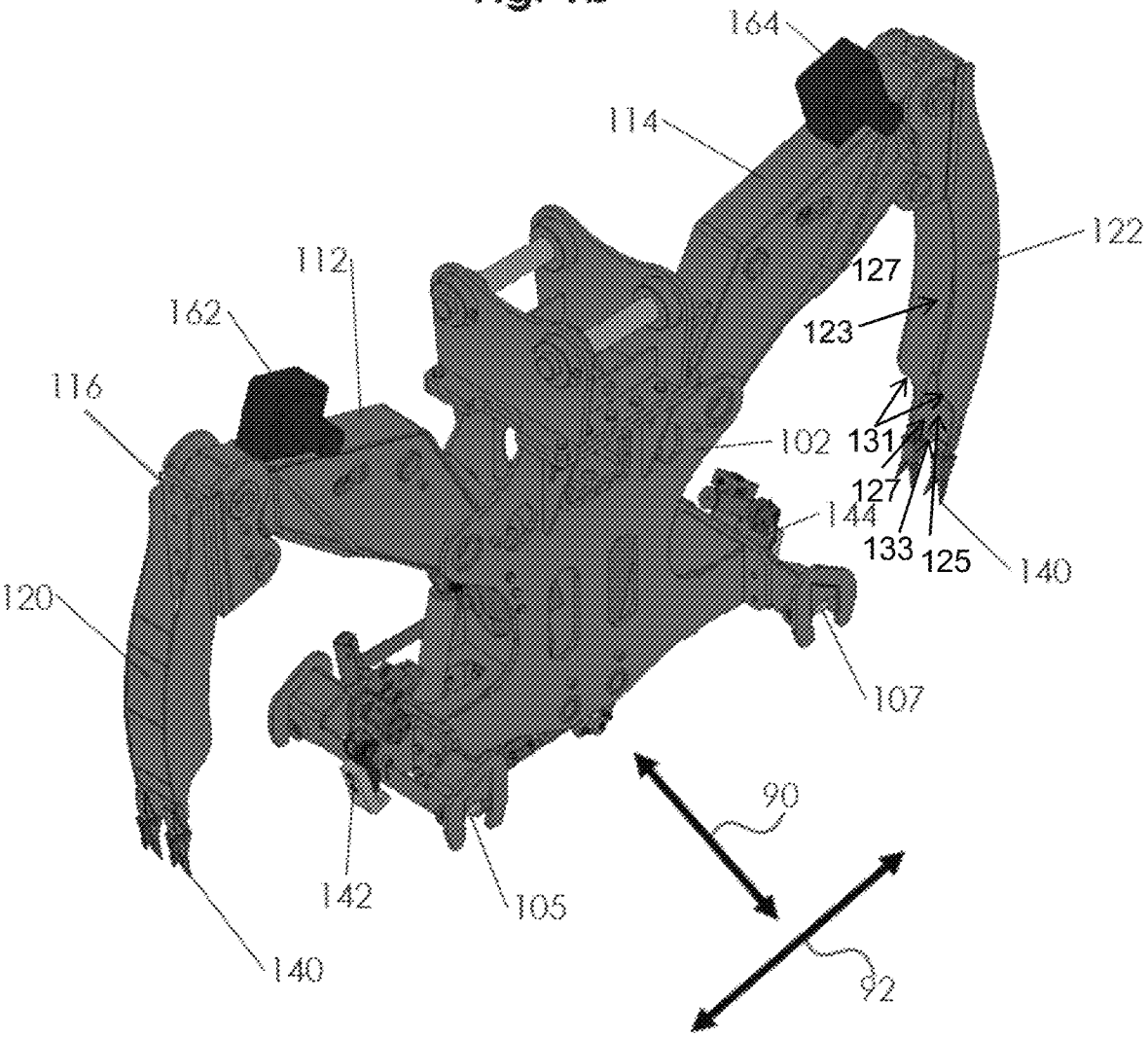
FIG. 1*b* illustrates a perspective view of a dual ballast cribber in a cleanout position having cribber buckets in a closed position.
Figure 2A:
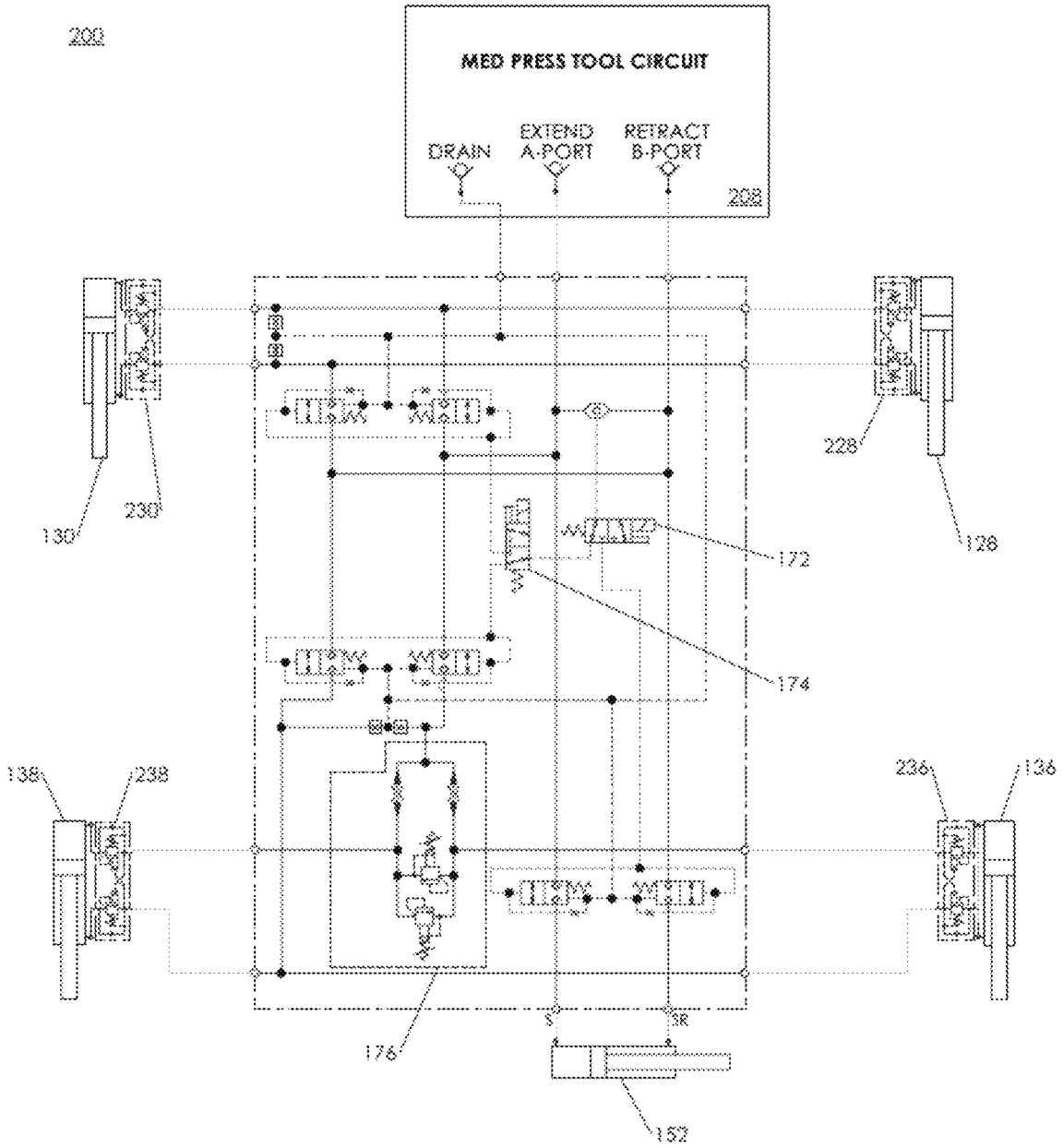
FIG. 2*a* illustrates a schematic of medium pressure circuit including a cleanout circuit of a hydraulic system of the dual ballast cribber.
Figure 2B:
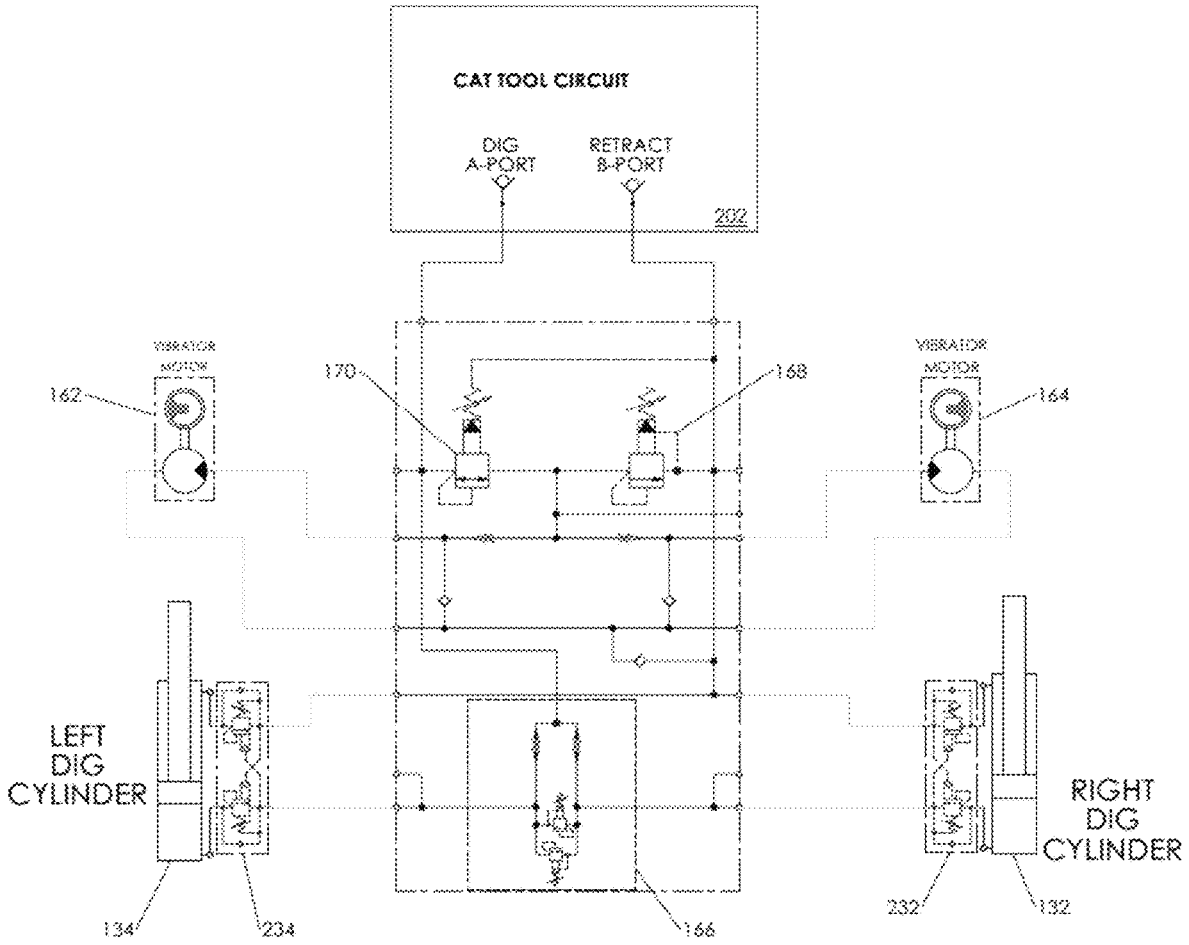
FIG. 2*b* illustrates a schematic of a dig circuit of the hydraulic system of the dual ballast cribber.

FIG. 1*b* is a perspective view of the dual ballast cribber 100 in a cleanout position having cribber buckets in a closed position. FIG. 1*b* illustrates the first pivot arm 112, the second pivot arm 114, and the central frame 102 as configured to protect a portion of the hydraulic system 200 (FIGS. 2*a* and 2*b*). The first pivot arm 112 and the second pivot arm 114 may be configured to protect a first cleanout cylinder 136 and a second cleanout cylinder 138 of the hydraulic system 200, respectively. The central frame 102 may be configured to protect a first dig cylinder 132 and the second dig cylinder 134 during the dig cycle. In the cleanout position the first pivot arm 112 and the second pivot arm 114 are angled upward with respect to the horizontal from their respective proximal end to their respective distal end, such as from 30 to 60 degrees. In the cleanout position the first cribber bucket 120 and the second cribber bucket 122 are raised above the railway. In the closed position, the first cribber bucket 120 and the second cribber bucket 122 are pivoted so that the cribber buckets' respective distal ends are more proximal to the central frame 102 than when the cribber buckets are in their respective open positions.

FIGS. 2*a* and 2*b* illustrates the hydraulic system 200 of the dual ballast cribber 100. The hydraulic system 200 includes a first clamp cylinder 128, a second clamp cylinder 130, dig circuit 202, and a cleanout circuit 208. The first clamp cylinder 128 and the second clamp cylinder 130 are configured to clamp the dual ballast cribber 100 to the rail of the railway during digging and cleanout and to unclamp the dual ballast cribber 100 from the rail of the railway during transport of the dual ballast cribber. In the cleanout and digging positions the first clamp cylinder 128 and the second clamp cylinder 130 can be extended. During transport of the dual ballast cribber 100, the first clamp cylinder 128 and the second clamp cylinder 130 can be retracted.

Optionally, the first clamp cylinder 128 and the second clamp cylinder 130 can have a bore of 2.0 inches (5.08 centimeters (cm), a rod of 1.125 inches (2.8575 cm), a stroke of 2.0 inches (5.08 cm), and a rod pin diameter of 1.0 inches (2.54 cm). The first clamp cylinder 128 may include a first clamp counterbalance (CB) valve 228 and the second clamp cylinder 130 may include a second clamp CB valve 230. The first clamp CB valve 228 and the second clamp CB valve 230 are configured to prevent unclamping of the first clamp 124 and the second clamp 126 from unclamping if the first clamp cylinder 128 or second clamp cylinder 130 fail. The first clamp CB valve 228 and the second clamp CB valve 230 can have a CB valve ratio from 3:1 or greater.

The dig circuit 202 can include the first dig cylinder 132 and a second dig cylinder 134 and can be configured to rotationally move the first pivot arm 112 and the second pivot arm 114, respectively, rotationally downward during digging and rotationally upward during cleanout. The dig circuit 202 may further be configured to clamp the first clamp cylinder 128 and the second clamp cylinder 130 when engaged and unclamp the first clamp cylinder 128 and the second clamp cylinder 130 when disengaged. The dig circuit 202 can have a minimum flow rate of approximately 20 gallons per minutes (gpm) (0.07571 cubic meters per minute ($m^3$/min)), a maximum flow rate of 30 gpm (0.1136 $m^3$/min), a maximum operating pressure of 5000 pounds per square inch (psi) (351.5 kilogram per square centimeter (kgf/$cm^2$)), and a relief setting at approximately 300 psi (21.09 kgf/$cm^2$). The first dig cylinder 132 and the second dig cylinder 134 can be in fluid communication via hydraulic circuitry lines.

The first dig cylinder 132 and the second dig cylinder 134 may have a bore of approximately 5 inches (12.7 cm), a rod of approximately 2.5 inches (6.35 cm), a stroke of approximately 14.0 inches (35.56 cm), and a pin diameter of 2.0 inches (5.08 cm). The first dig cylinder 132 can be in mechanical communication with the central frame 102 and the first pivot arm 112, and the second dig cylinder can be in mechanical communication with the central frame 102 and the second pivot arm 114. In the dig position, the first dig cylinder 132 and the second dig cylinder 134 can be extended. In the cleanout position, the first dig cylinder 132 and the second dig cylinder 134 can be retracted.

The first dig cylinder 132 may have a first dig CB valve 232 and the second dig cylinder 134 may have a second dig CB valve 234. The first dig CB valve 232 and the second dig CB valve 234 can be configured to prevent load falling during cleanout in the event of failure of the first dig cylinder 132 or the second dig cylinder 134, and may further be configured to improve motion control during the cleanout and dig functions. The first dig CB valve 232 and the second dig CB valve 234 can have a low CB valve ratio from 5:1 or less. According to some aspects, the first dig CB valve 232 and the second dig CB valve 234 have a CB valve ration of 3:1.

A hydraulic divider/combiner cleanout cylinder valve 176 can distribute hydraulic pressure between the first and second cleanout cylinders 136, 138. Similarly, a hydraulic divider/combiner dig cylinder valve 166 can distribute hydraulic pressure between the left and right dig cylinders 134, 136. The hydraulic divider/combiner dig cylinder valve 166 and the hydraulic divider/combiner cleanout cylinder valve 176 can be 50:50 flow dividers.

Figure 3:
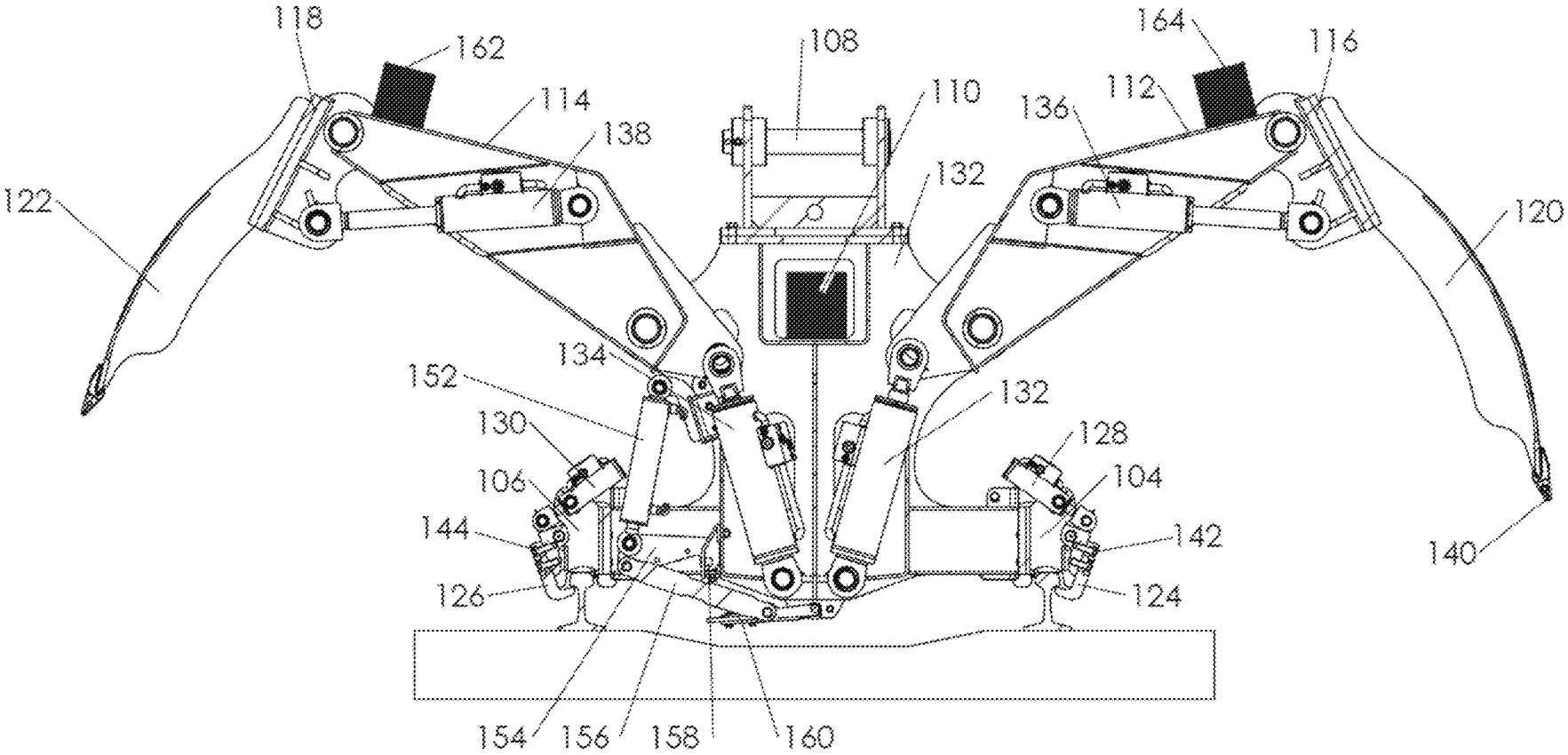
FIG. 3 illustrates a front view of the dual ballast cribber in a cleanout position having cribber buckets in an open position.

A cleanout circuit 208 can include a first cleanout cylinder 136 and a second cleanout cylinder 138 and can be configured to rotate each of the first cribber bucket 120 and the second cribber bucket 122 rotationally downward to the closed position for digging and rotationally upward to an open position for cleanout (e.g., tilted as in FIG. 3 so that ballast can fall directly downward from the cribber buckets). The cleanout circuit 208 may further be configured to clamp the first clamp cylinder 128 and the second clamp cylinder 130 when engaged and unclamp the first clamp cylinder 128 and the second clamp cylinder 130 when disengaged. The cleanout circuit 208 can have a minimum flow rate of approximately 11 gpm (0.04164 $m^3$/min), a maximum flow rate of 20 gpm (0.075771 $m^3$/min), a maximum operating pressure of approximately 3500 psi (246.1 kgf/$cm^2$), and a relief setting of approximately 3000 psi (210.9 kgf/$cm^2$). The first cleanout cylinder 136 and the second cleanout cylinder 138 can be in fluid communication via hydraulic circuitry lines.

Optionally, the first cleanout cylinder 136 and the second cleanout cylinder 138 may have a bore of approximately 4 inches (10.16 cm), a rod of approximately 2.25 inches (5.715 cm), and a stroke of approximately 8 inches (20.32 cm), and a pin diameter of 2.0 inches (5.08 cm). The first cleanout cylinder 136 is in mechanical communication with the first pivot arm 112 and the first cribber bucket 120, and the second cleanout cylinder 138 is in mechanical communication with the second pivot arm 114 and the second cribber bucket 122. To position the first and second cribber buckets 120, 122 in the closed position, the first cleanout cylinder 136 and the second cleanout cylinder 138 can be retracted. To position the first and second cribber buckets 120, 122 in the open position, the first cleanout cylinder 136 and the second cleanout cylinder 138 can be extended.

The first cleanout cylinder 136 may include a first cleanout CB valve 236, and the second cleanout cylinder 138 may include a second cleanout CB valve 238. The first cleanout CB valve 236 and the second cleanout CB valve 238 can be configured to prevent load falling during cleanout in the event of failure of the first cleanout cylinder 136 or the second cleanout cylinder 138, and may further be configured to improve motion control moving between the open and close positions. The first cleanout CB valve 236 and the second cleanout CB valve 238 can have a low CB valve ratio from 5:1 or less. According to some aspects, the first cleanout CB valve 236 and the second cleanout CB valve 238 have a CB valve ratio of 3:1.

Referring to FIGS. 1*a* and 2*b*, the dual ballast cribber 100 can comprise vibratory motors 162, 164 that can be positioned at distal ends of the first and second pivot arms 112, 114, respectively, and can be configured to vibrate to enhance penetration into the ballast. For example, in certain conditions in which ballast is significantly compacted, the first and second dig cylinders 132, 134 can stall. As the dig cylinders 132, 134 stall, the hydraulic pressure can build. A vibrator sequence valve 170 can be included within the dig circuit 202 and in fluid communication with fluid in the first and second dig cylinders 132, 134. The vibrator sequencing valve 170 can be configured to trip at a predetermined hydraulic pressure threshold (e.g., 2000 psi). When the sequence valve 170 trips, the dig circuit 202 can provide hydraulic fluid to the pair of vibratory motors 162, 164. The vibratory motors 162, 164 can cause vibrations that propagate to the first and second cribber buckets 120, 122. The vibrations can release the interlocking characteristics of the ballast and allow the buckets continue penetration. The hydraulic pressure in the vibrator circuit can be maintained via a vibrator relief valve 168.

The dual ballast cribber 100 can comprise a sweep plate 160 that is configured to move any ballast from the center of the crib that the first and second cribber buckets 120, 122 cannot efficiently reach and remove from the crib. For example, as the first and second cribber buckets 120, 122 dig into the ballast, they can tend to generate a pile of ballast at the center of the rail. The sweep plate 160 can be centered at the bottom of the central frame 102, between and below the first and second clamps 124, 126, and pivotally sweep below the central frame 102 to shift any ballast that within its range of sweep. Accordingly, the sweep plate 160 can sweep about and between the first side of the central frame and the second side of the central frame along the transverse axis 92. The sweep plate 160 can be a planar or generally planar plate that is elongated along the longitudinal dimension 90 of the railway. The sweep plate can be pivotably attached to the central frame 102 by a pair of arms, one disposed at each longitudinal end of the plate. A sweep plate cylinder 152 can extend to drive a pivot linkage 154 about its axis at a pivot pin 158. The pivot linkage 154 can, in turn, move a push linkage 156 that connects to the sweep plate 160, thereby actuating the sweep plate 160. In this way, the sweep plate can move ballast from the middle of the rails and position the ballast in more accessible areas for the first and second cribber buckets 120, 122 to reach it. Optionally, the sweep plate 160 can be actuated to sweep as the cribber buckets 120, 122 are moved outwardly to their respective cleanout positions.

The cleanout circuit 208 can be configured so that each of the sweep cylinder 152, the first and second clamp cylinders 128, 130, and the first and second cleanout cylinders 136, 138 can each be controlled independently. For example, solenoids 172, 174 can be independently actuated. When the solenoid 172 is actuated, the sweep plate cylinder 152 can be actuated. When the solenoid 174 is actuated, the first and second clamp cylinders 128, 130 can be actuated.

FIG. 3 represents a front view of the dual ballast cribber 100 in a cleanout position having the first cribber bucket 120 and the second cribber bucket 122 in an open position. In the cleanout position, the first pivot arm 112 and the second pivot arm 114 can be angled upward at substantially 45 degrees. In the cleanout position, the first cribber bucket 120 and the second cribber bucket 122 can be raised above the railway, and the first dig cylinder 132 and the second dig cylinder 134 are retracted. In the open position, the first cribber bucket 120 and the second cribber bucket 122 are pivoted so that the cribber buckets' respective distal ends are further from the central frame 102 than when the cribber buckets are in their respective closed positions. In the open positon, the first cleanout cylinder 136 and the second cleanout cylinder 138 can be extended.

Figure 4:
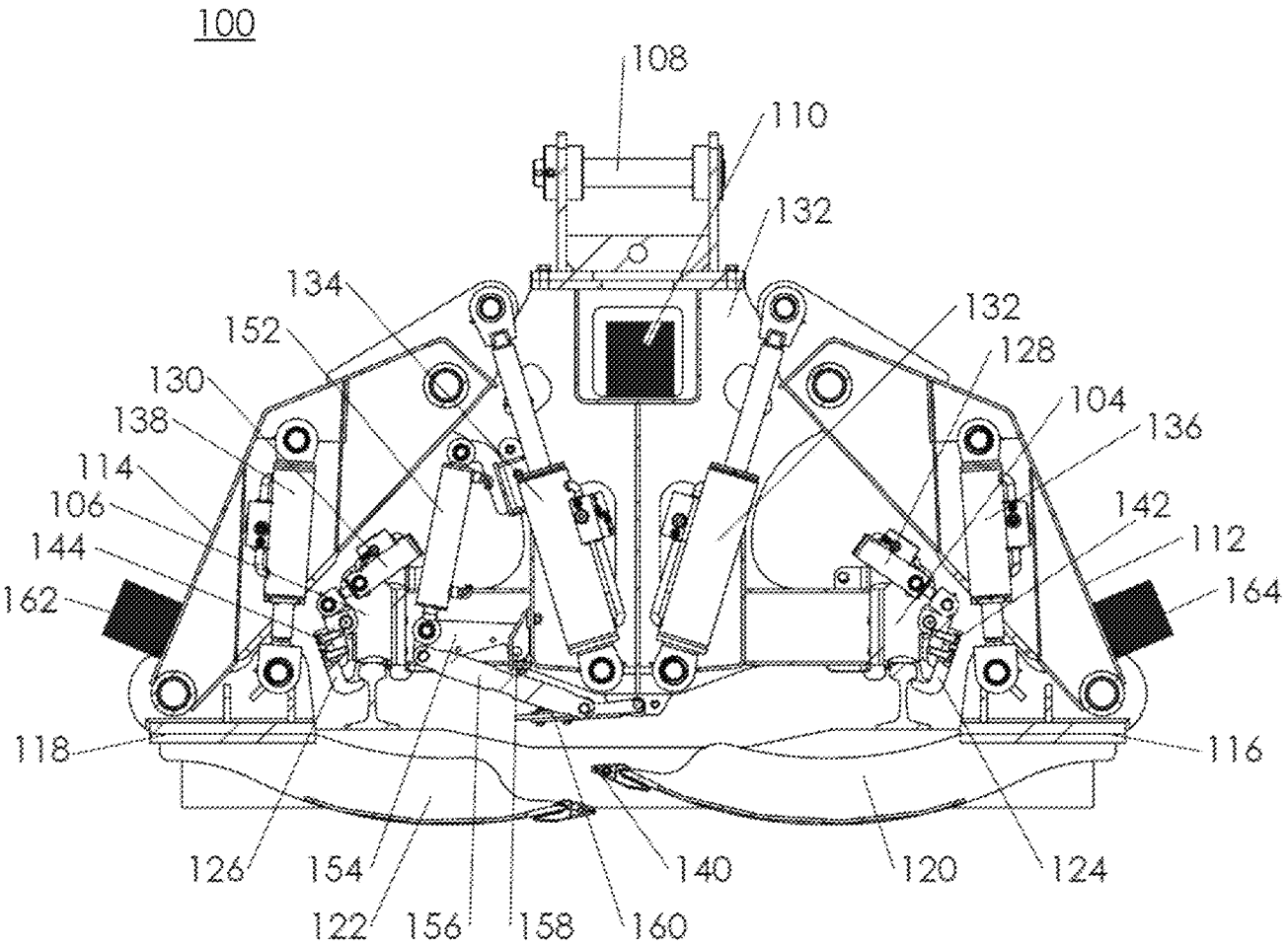
FIG. 4 illustrates a front view of the dual ballast cribber in a digging position having cribber buckets in a closed position.

FIG. 4 represents dual ballast cribber 100 in a digging position having the first cribber bucket 120 and the second cribber bucket 122 in a closed position. In the digging position, the first pivot arm 112 and the second pivot arm 114 can be angled downward at substantially 45 degrees. In the digging position, the first cribber bucket 120 and the second cribber bucket 122 can be engaged in ballast beneath the railway and can be substantially parallel to the transverse axis 92. Optionally, respective distal ends of the cribber buckets 120, 122 can extend past each other in the transverse dimension 92 so that the buckets can have overlapping portions. In the digging position, the first dig cylinder 132 and the second dig cylinder 134 can be extended. In the closed position, the first cribber bucket 120 and the second cribber bucket 122 are pivoted so that the cribber buckets' respective distal ends are more proximal to the central frame 102 than when the cribber buckets are in their respective open positions. In the closed positon, the first cleanout cylinder 136 and the second cleanout cylinder 138 can be retracted.

Figure 5:
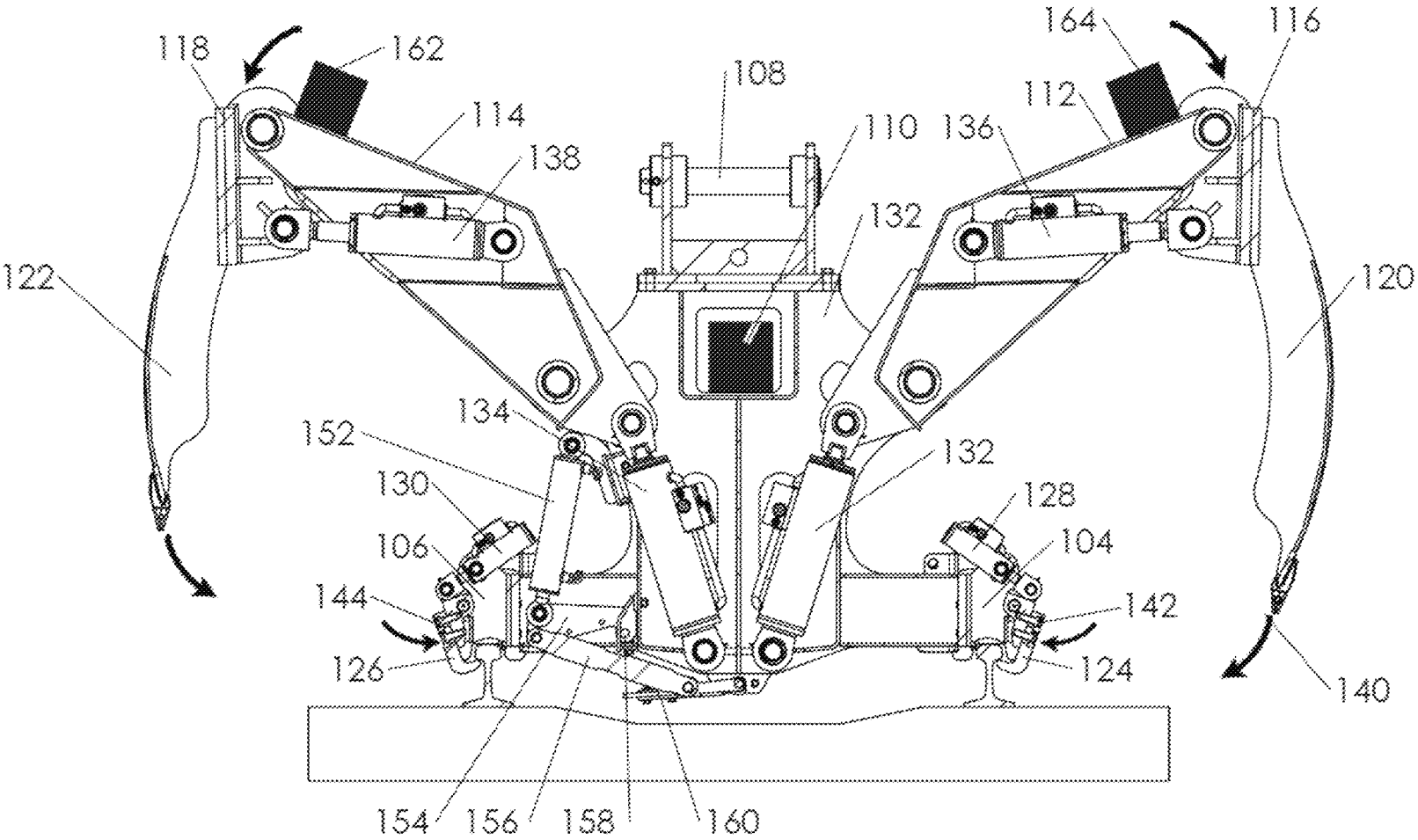
FIG. 5 illustrates a front view of the dual ballast cribber and movement of components during digging.

FIG. 5 illustrates a method of digging with the dual ballast cribber 100 to remove fouled ballast from both sides of a railway, optionally, simultaneously or nearly simultaneously. The dual ballast cribber 100 can be aligned on the railway for removal of fouled ballast. The laser 110 to properly position the first cribber bucket 120 and the second cribber bucket 122 for fouled ballast removal. The first clamp 124 and the second clamp 126 can be engaged via the first clamp cylinder 128 and the second clamp cylinder 130 to clamp the first wheel 104 and the second wheel 106, respectively, to the railway. The dig circuit 200 can be used to extend the first dig cylinder 132 and the second dig cylinder 134, optionally, simultaneously or nearly simultaneously, to move the first pivot arm 112 and the second pivot arm 114 rotationally downward. As the first pivot arm 112 and the second pivot arm 114 move rotationally downward, the first cribber bucket 120 and the second cribber bucket 122 can contact and break apart the fouled or cemented ballast, optionally, simultaneously or nearly simultaneously.

Figure 6:
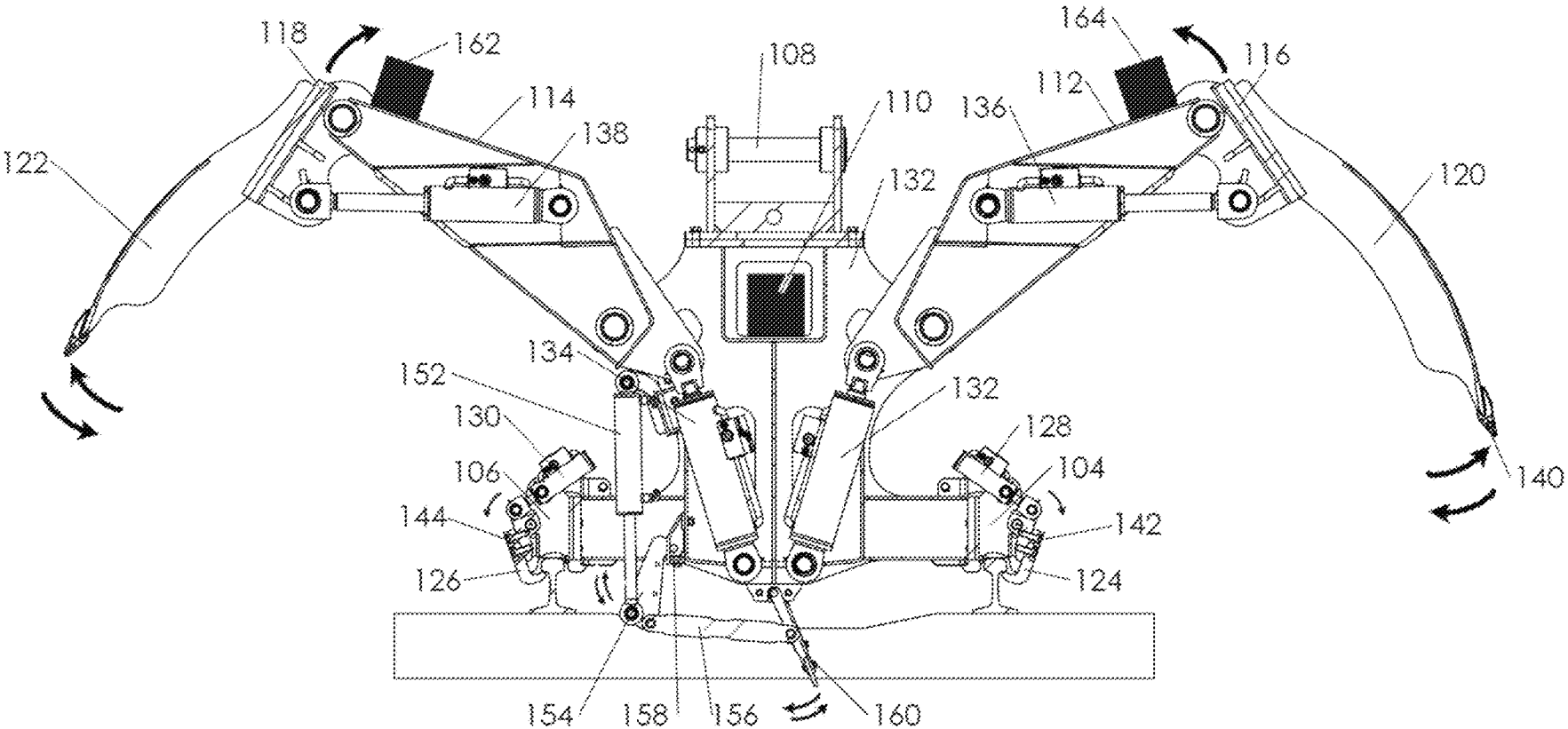
FIG. 6 illustrates a front view of the dual ballast cribber and movement of components during cleanout.

FIG. 6 illustrates a method of cleanout with the dual ballast cribber 100. The dig circuit can be used to retract the first dig cylinder 132 and the second dig cylinder 134, optionally, simultaneously or nearly simultaneously, to move the first pivot arm and the second pivot arm 114 rotationally upward. The first cribber bucket 120 and the second cribber bucket 122 can be in the closed position and filled with fouled ballast. Upon full retraction of the first dig cylinder 132 and the second dig cylinder 134, the cleanout circuit 208 can be used to extend the first cleanout cylinder 136 and the second cleanout cylinder 138, optionally, simultaneously or nearly simultaneously, to rotationally move the first cribber bucket 120 and the second cribber bucket 122 to the open position. As the first cribber bucket 120 and the second cribber bucket 122 move to the open position, fouled ballast can be dumped from the first cribber bucket 120 and the second cribber bucket 122.

Upon dumping the fouled ballast, the cleanout circuit 208 can be used to retract the first cleanout cylinder 136 and the second cleanout cylinder 138, optionally, simultaneously or nearly simultaneously, to move the first cribber bucket 120 and the second cribber 122 to the closed position. Upon achieving the closed position, the first clamp cylinder 124 and the second clamp cylinder 126 can be disengaged to retract the first clamp cylinder 124 and the second clamp cylinder 126. The dual ballast cribber 100 can then be moved on rail to align it at a next position on the railway. A digging cycle (the method of digging and the method of cleanout) may be performed in 2 minutes or less. According to some aspects, the digging cycle is performed in 45 seconds or less. Although as described herein, the first and second cribber buckets 120, 122 move to and from open and closed positions, it should be understood that the first and second cribber buckets can move about and between these positions and do not necessarily have to move to the full extent of their respective ranges of motion to perform digging and cleanout functions. Similarly, the first and second cribber buckets 120, 122 can move about and between their respective digging positions and cleanout positions and do not necessarily have to be move to the full extent of their respective ranges of motion. In some embodiments, an operator can determine various operation parameters, such as positions of the first and second cribber buckets, while in further embodiments, the movement of the dual ballast cribber can be automated.

According to one exemplary method, the dual ballast cribber can be clamped to the railway. The dual ballast cribber 100 can be aligned over the crib on the rail. An operator can press a clamp select button to engage the clamp function enable valve (solenoid) 174. The medium pressure circuit can then be activated to extend cylinders 128, 130, thereby moving the respective clamps 124, 126 clamp and thereby engage respective rails. The operator can then deactivate the medium pressure circuit and release the clamp select button.

According to one exemplary method, the dual ballast cribber 100 can then be used to dig/clean the ballast via a digging method. To begin an exemplary digging method, the cat tool extend circuit (of the dig circuit) can be activated to extend the first and second dig cylinders 132, 134. The first and second dig cylinders 132, 134 can be extended until the buckets engage crib shoulders. The medium pressure extend circuit (of the cleanout circuit) can then be activated to extend the first and second cleanout cylinders 136, 138. The first and second cleanout cylinders 136, 138 can be extended until the ballast is pushed out from underneath the railway. The medium pressure retract circuit can be activated to retract the first and second cleanout cylinders 136, 138. The first and second dig cylinders 132, 134 can then be extended until the buckets are fully engaged with the ballast (e.g., at their full range of motion). Vibrator motors 162, 164 can be triggered via the vibrator circuit sequencing valve 170 (e.g., at 2000 psi). The cat tool retract circuit can be activated to retract the first and second dig cylinders 132, 134 until the bucket tips are even with the crib shoulder bottom. The medium pressure extend circuit can extend the first and second cleanout cylinders 136, 138 until the ballast is dumped from the cribber buckets. The operator can press a button to engage the sweep function enable (solenoid) valve 172. The medium pressure circuit can be activated to extend and retract the sweep cylinder 152, thereby moving the sweep plate 160. The sweep plate 160 can be repeatedly swept until the material is satisfactorily swept. The operator can then release the button to disengage the sweep function enable (solenoid) valve 172 to thereby complete the digging method. The operator can repeat the digging method as necessary until the ballast is satisfactory.

According to one exemplary method, the dual ballast cribber can be unclamped from the railway. The operator can press the button to engage the clamp function enable (solenoid) valve 174. The medium pressure (cleanout) circuit can then be activated to retract cylinders 128, 130, thereby moving the respective clamps 124, 126 clamp and thereby disengage engage respective rails. The operator can then release the button to disengage the clamp function enable (solenoid) valve 174.

Exemplary Aspects

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A dual ballast cribber for removing fouled and cemented ballast from beneath a railway, wherein the railway has a longitudinal axis, the dual ballast cribber comprising: a central frame; a plurality of wheels rotatably attached to the central frame; a first pivot arm that is pivotably attached to the central frame; a first cribber bucket that is pivotably attached to the first pivot arm, wherein the first pivot arm is configured to position the first cribber bucket about and between a digging position and a cleanout position; a second pivot arm that is pivotably attached to the central frame; a second cribber bucket that is pivotably attached to the second pivot arm, wherein the second pivot arm is configured to position the second cribber bucket about and between a digging position and a cleanout position; a first clamp that is in mechanical communication with the central frame and configured to secure the dual ballast cribber to the railway; and at least one actuator configured to move each of the first and second cribber buckets between the respective digging position and the respective cleanout position, wherein, when in the digging position, each respective cribber bucket is disposed at least partially below the central frame, and when in the respective cleanout position, the respective cribber bucket is positioned outwardly from the central frame relative to a transverse axis that is perpendicular to the railway axis.

Aspect 2: The dual ballast cribber of aspect 1, wherein the at least one actuator comprises two hydraulic actuators, wherein each actuator of the two hydraulic actuators is configured to move a respective pivot arm of the first and second pivot arms.

Aspect 3: The dual ballast cribber of aspects 1 or aspect 2, wherein the central frame of the dual ballast cribber has a first side and a second side, wherein the first side and the second side are spaced from each other on the transverse axis, wherein the first pivot arm extends from the first side of the central frame, and wherein the second pivot arm extends from the second side of the central frame.

Aspect 4: The dual ballast cribber of any of aspects 1-3, further comprising a second clamp that is in mechanical communication with the central frame and configured to secure the dual ballast cribber to the railway, wherein the first clamp is on the first side of the central frame, and the second clamp is on the second side of the central frame.

Aspect 5: The dual ballast cribber of any of aspects 1-4, wherein the first cribber bucket is from 0.10 to 0.35 meters in width.

Aspect 6: The dual ballast cribber of any of aspects 1-5, wherein the first cribber bucket is from 0.7 to 1.7 meters in length.

Aspect 7: The dual ballast cribber of any of aspects 1-6, wherein the first cribber bucket is adjustably coupled to the first pivot arm so a distal end of the first cribber bucket can be positioned at a select distance from a pivotal axis of the first cribber bucket.

Aspect 8: The dual ballast cribber of any of aspects 1-7, wherein the first clamp is adjustably coupled to the central frame so that a distal end of the first clamp can be positioned at a select distance from a pivotal end of the first clamp.

Aspect 9: The dual ballast cribber of any of aspects 1-8, further comprising: a sweep plate that is pivotably attached to the central frame about a pivotal axis; and a sweep plate actuator that is configured to pivot the sweep plate about the pivotal axis of the sweep plate.

Aspect 10: The dual ballast cribber of any of aspects 1-9, further comprising at least one vibrator motor that is configured to cause at least one of the first cribber bucket and the second cribber bucket to vibrate.

Aspect 11: The dual ballast cribber of aspect 10, further comprising a vibrator sequence valve that is configured to deliver hydraulic fluid to the at least one vibrator motor when a hydraulic pressure surpasses a predetermined threshold.

Aspect 12: The dual ballast cribber of aspect 10 or aspect 11, wherein the at least one vibrator motor is attached to at least one of the first pivot arm and the second pivot arm.

Aspect 13: The dual ballast cribber of any of aspects 1-12, further comprising: a first clamp cylinder configured to engage and disengage the first clamp; a second clamp cylinder configured to engage and disengage the second clamp; and a dig circuit configured rotationally move the first pivot arm and the second pivot arm.

Aspect 14: The dual ballast cribber of any of aspects 1-13, wherein the at least one actuator comprises: a first dig cylinder that is in mechanical communication with the central frame and the first pivot arm and is in fluid communication with the dig circuit, and a second dig cylinder that is in mechanical communication with the central frame and the second pivot arm and is in fluid communication with the dig circuit.

Aspect 15: The dual ballast cribber of aspect 14, further comprising: a cleanout circuit configured to rotationally move the first cribber bucket and the second cribber bucket, the cleanout circuit comprising: a first cleanout cylinder that is in mechanical communication with the first pivot arm and the first cribber bucket and is in fluid communication with the cleanout circuit, and a second cleanout cylinder that is in mechanical communication with the second pivot arm and the second cribber bucket and is in fluid communication with the cleanout circuit.

Aspect 16: The dual ballast cribber of aspect 13, wherein the first clamp cylinder and the second clamp cylinder are in fluid communication with the dig circuit.

Aspect 17: The dual ballast cribber of aspect 14, wherein the first clamp cylinder and the second clamp cylinder are in fluid communication with the cleanout circuit.

Aspect 18: A method of performing a digging cycle to remove fouled and cemented ballast from a railway with a dual ballast cribber, comprising: with a dual ballast cribber aligned on a railway, the dual ballast cribber having a central frame, first and second clamps in mechanical communication with the central frame, first and second pivot arms that are pivotably attached to the central frame, and first and second cribber buckets that are pivotably attached, respectively, to the first and second pivot arms, using the first clamp and the second clamp to clamp the dual ballast cribber to the railway for digging; using a dig circuit to move the first pivot arm and the second pivot arm rotationally downward, wherein the first cribber bucket and the second cribber bucket approximately simultaneously contact ballast underneath the railway; using the dig circuit to move the first pivot arm and the second pivot arm rotationally upward; using a cleanout circuit to move the first cribber bucket and the second cribber bucket to an open position to expel the ballast from the first cribber bucket and the second cribber bucket; and disengaging the first clamp and the second clamp from the railway to complete the digging cycle.

Aspect 19: The method of aspect 18, wherein the digging cycle is completed in two minutes or less.

Aspect 20: The method of aspect 19, wherein the digging cycle is completed in forty-five seconds or less.

The invention claimed is:

1. A dual ballast cribber for removing fouled and cemented ballast from beneath a railway, the railway having a longitudinal axis, the dual ballast cribber comprising:

a central frame;

a plurality of wheels rotatably attached to the central frame;

a first pivot arm that is pivotably attached to the central frame;

a first cribber bucket that is pivotably attached to the first pivot arm, wherein the first pivot arm is configured to position the first cribber bucket about and between a digging position and a cleanout position;

a second pivot arm that is pivotably attached to the central frame;

a second cribber bucket that is pivotably attached to the second pivot arm, wherein the second pivot arm is configured to position the second cribber bucket about and between a digging position and a cleanout position;

a dig circuit configured to rotationally move the first pivot arm and the second pivot arm;

at least one actuator configured to move each of the first and second cribber buckets between the respective digging position and the respective cleanout position; and a cleanout circuit configured to rotationally move the first cribber bucket and the second cribber bucket, the cleanout circuit comprising:

a first cleanout cylinder that is in mechanical communication with the first pivot arm and the first cribber bucket and is in fluid communication with the cleanout circuit, and a second cleanout cylinder that is in mechanical communication with the second pivot arm and the second cribber bucket and is in fluid communication with the cleanout circuit, wherein each of the first and second cribber bucket comprises a base portion and side walls that extend from the base portion on each side of the respective cribber bucket, wherein the base portion and the side walls of each of the first and second cribber buckets comprise front edges, wherein the front edges of the respective base portion and the respective side walls of each cribber bucket define a front opening of the cribber bucket.

2. The dual ballast cribber of claim 1, wherein the at least one actuator comprises two hydraulic actuators, wherein each actuator of the two hydraulic actuators is configured to move a respective pivot arm of the first and second pivot arms.

3. The dual ballast cribber of claim 1, wherein the central frame of the dual ballast cribber has a first side and a second side, wherein the first side and the second side are spaced from each other on the transverse axis, wherein the first pivot arm extends from the first side of the central frame, and wherein the second pivot arm extends from the second side of the central frame.

4. The dual ballast cribber of claim 3, further comprising:

a first clamp that is in mechanical communication with the central frame and configured to secure the dual ballast cribber to the railway; and a second clamp that is in mechanical communication with the central frame and configured to secure the dual ballast cribber to the railway, wherein the first clamp is secured to the first side of the central frame, and the second clamp is secured to the second side of the central frame.

5. The dual ballast cribber of claim 4, wherein the first clamp is adjustably coupled to the central frame so that a distal end of the first clamp can be positioned at a select distance from a pivotal end of the first clamp.

6. The dual ballast cribber of claim 1, wherein the first cribber bucket is from 0.10 to 0.35 meters in width.

7. The dual ballast cribber of claim 1, wherein the first cribber bucket is from 0.7 to 1.7 meters in length.

8. The dual ballast cribber of claim 1, wherein the first cribber bucket is adjustably coupled to the first pivot arm so a distal end of the first cribber bucket can be positioned at a select distance from a pivotal axis of the first cribber bucket.

9. The dual ballast cribber of claim 1, further comprising:

a sweep plate that is pivotably attached to the central frame about a pivotal axis; and a sweep plate actuator that is configured to pivot the sweep plate about the pivotal axis of the sweep plate.

10. The dual ballast cribber of claim 1, further comprising at least one vibrator motor that is configured to cause at least one of the first cribber bucket and the second cribber bucket to vibrate.

11. The dual ballast cribber of claim 10, further comprising a vibrator sequence valve that is configured to deliver hydraulic fluid to the at least one vibrator motor when a hydraulic pressure surpasses a predetermined threshold.

12. The dual ballast cribber of claim 10, wherein the at least one vibrator motor comprises a first vibrator motor attached to the first pivot arm and a second vibrator motor attached to the second pivot arm.

13. The dual ballast cribber of claim 1, wherein the at least one actuator comprises:

a first dig cylinder that is in mechanical communication with the central frame and the first pivot arm and is in fluid communication with the dig circuit, and a second dig cylinder that is in mechanical communication with the central frame and the second pivot arm and is in fluid communication with the dig circuit.

14. A method of performing a digging cycle to remove fouled and cemented ballast from a railway, comprising:

aligning a dual ballast cribber on a railway, the dual ballast cribber having a central frame, first and second pivot arms that are pivotably attached to the central frame, and first and second cribber buckets that are pivotably attached, respectively, to the first and second pivot arms;

using a dig circuit to move the first pivot arm and the second pivot arm rotationally downward, wherein the first cribber bucket and the second cribber bucket approximately simultaneously contact ballast underneath the railway;

using the dig circuit to move the first pivot arm and the second pivot arm rotationally upward; and using a cleanout circuit to move the first cribber bucket and the second cribber bucket to an open position to expel the ballast from the first cribber bucket and the second cribber bucket.

15. The method of claim 14, wherein the digging cycle is completed in two minutes or less.

16. The method of claim 15, wherein the digging cycle is completed in 45 seconds or less.

17. The method of claim 14, wherein each of the first and second cribber buckets is configured to:

receive ballast as the respective cribber bucket moves toward the respective digging position; and dump ballast therefrom as the respective cribber bucket moves toward the respective cleanout position.

18. The method of claim 14, wherein each of the first and second cribber bucket comprises a base portion and side walls that extend from the base portion on each side of the respective cribber bucket, wherein the base portion and the side walls of each of the first and second cribber buckets comprise front edges, wherein the front edges of the respective base portion and the respective side walls of each cribber bucket define a front opening of the cribber bucket.

* * * * *